United States Patent [19]

Girotti et al.

[11] 4,014,450

[45] Mar. 29, 1977

[54] PACKAGING CONTAINER

[75] Inventors: Floriano Girotti, Milan; Mauro Gasparini, Segrate (Milan), both of Italy

[73] Assignee: Montefibre S.p.A., Milan, Italy

[22] Filed: Aug. 2, 1971

[21] Appl. No.: 168,313

[30] Foreign Application Priority Data

Aug. 10, 1970 Italy ..... 28464/70

[52] U.S. Cl. ..... 220/4 E; 220/4 B; 220/72; 220/354; 220/355

[51] Int. Cl.[2] ..... B65D 43/06; B65D 7/02

[58] Field of Search ..... 220/4 R, 4 A, 4 B, 4 E, 220/42 D, 42 F, 60 R, 72, 42 A, 42 B, 42 C, 31 S, 354, 355; 229/16 C; 206/508

[56] References Cited

UNITED STATES PATENTS

| | | | |
|---|---|---|---|
| 891,085 | 6/1908 | Leahy et al. | 220/4 B |
| 2,289,037 | 7/1942 | Poglein | 220/4 E |
| 2,336,699 | 12/1943 | Neth et al. | 220/4 E |
| 2,377,989 | 6/1945 | Braun | 229/16 C |
| 2,899,097 | 8/1959 | Haskins | 220/4 E |
| 2,999,611 | 9/1961 | Paulson | 220/4 E |
| 3,032,228 | 5/1962 | Andrews | 220/4 E |
| 3,145,870 | 8/1964 | Lockwood | 220/4 E |
| 3,251,460 | 5/1966 | Edmonds | 220/4 E |
| 3,272,379 | 9/1966 | Driza et al. | 220/31 S |
| 3,360,152 | 12/1967 | Leers | 220/4 E |
| 3,516,573 | 6/1970 | Mizuk | 220/72 |

FOREIGN PATENTS OR APPLICATIONS

| | | | |
|---|---|---|---|
| 462,706 | 10/1968 | Switzerland | 220/4 E |

*Primary Examiner*—William Price
*Assistant Examiner*—Allan N. Shoap
*Attorney, Agent, or Firm*—Hubbell, Cohen, Stiefel & Gross

[57] ABSTRACT

A symmetrical container of desired cross-sectional polygon configuration having a floor and a plurality of upstanding side walls, at least one side wall having a flange of predetermined dimensions extending a predetermined distance above the upper end of the one side wall, and at least one other side wall having a recess extending below the upper end of the other side wall to define a groove having dimensions at least as great as that of the flange. Two identical containers may then be positioned in inverted relation with the flange of each container mated within the groove of each other container to thereby define a closed housing.

8 Claims, 6 Drawing Figures

INVENTORS
FLORIANO GIROTTI
MAURO GASPARINI
BY
ATTORNEYS.

PACKAGING CONTAINER

BACKGROUND OF THE INVENTION

1. Field of the Invention

This invention relates to packaging containers and, more particularly, to containers suitable for packaging textile materials, such as threads and yarns or the like.

2. Description of the Prior Art

Present textile material packaging containers generally are fabricated of cardboard which thereby subject them to breakage, bending, tearage, and environmental corrosion over a period of time. Such containers, therefore, have to be frequently replaced and require proper storage under optimum environmental conditions.

It is known that textile thread and yarns assume a variety of composite shapes, sizes and configurations during their working schedule. For instance, during its working schedule, a textile yarn may be collected on cops, reels and spindles or the like thereby assuming a bulky overall configuration. In order to efficiently utilize storage space, it was found necessary in the prior art to stock a plurality of differently dimensioned containers of the type above described to accomodate the yarn while in different stages of use during its working schedule. This led to increased costs and undue waste since the containers had to be frequently replaced due to change in bulk or volume of the textile material and often were discarded altogether due to environmental or handling deterioration.

SUMMARY OF THE INVENTION

The present invention relates to a housing for storing items of desired shape and size, such as textile materials or the like. The housing includes a uniquely configured symmetrical container which may serve only as the bottom of the housing to define the entire internal volume thereof, in which case a separate substantially planar cover is used, or as both the bottom and top of a housing having an internal volume double that of a single container alone. The latter is accomplished by positioning the containers in inverted interlocking relationship, the containers including integral interlocking means thereon to facilitate such relationship. It is, therefore, necessary to stock only one size container to form two distinct housings of different internal volume. This reduces costs and facilitates storage.

In another aspect of this invention, the container is fabricated of material that is resistant to environmental corrosion. This permits the above-described container to be used for prolonged periods of time. Preferably, the containers are plastic and are all made from a common mold. More particularly, it is preferred that the container material be a polyolefine, polypropylene consisting essentially of isotactic macromolecules being most preferred.

Generally speaking, the present invention relates to a housing for storing items of desired shape and size comprising a symmetrical container of desired cross-sectional polygon configuration having a floor and a plurality of side walls upstanding therefrom, at least one side wall having a flange extending above the upper end thereof, and at least one other side wall having a recess extending below the upper end thereof to define a groove having dimensions at least as great as the flange.

DESCRIPTION OF THE PREFERRED EMBODIMENT

Figure 1:
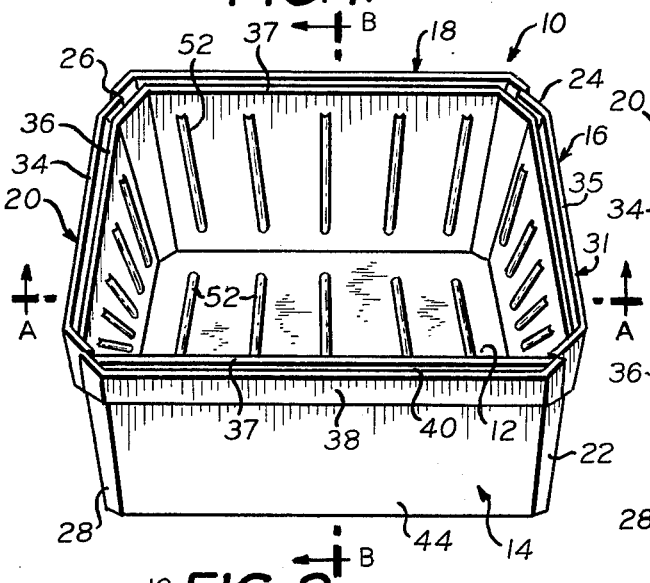
FIG. 1 is a top perspective view of a container according to the invention.
Figure 4:
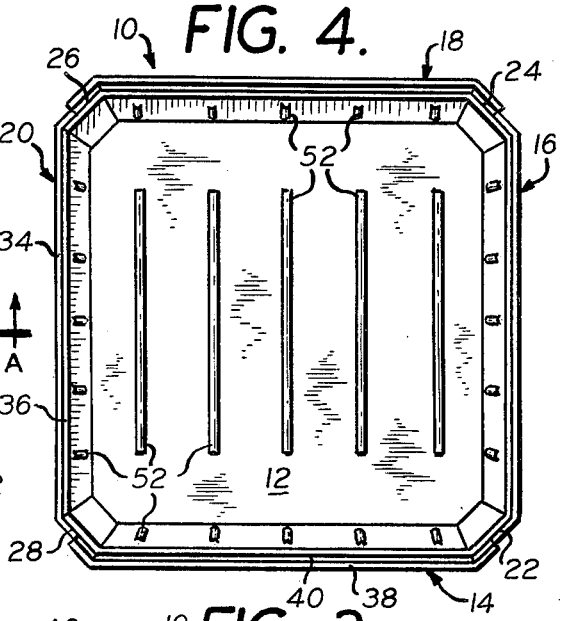
FIG. 4 is a top plan view of the container of FIG. 1.

A container 10 in accordance with this invention is shown in FIGS. 1–4. Container 10 is preferably used to store objects that may vary in size and shape during different periods of time, such as textile materials, fibers, yarn or the like during their working schedule. Container 10 may form at least the bottom of a housing for storing such objects. The nature and extent of such housing, and the precise manner of forming it, are described in detail below.

Container 10 is of symmetrical cross-sectional polygon configuration having a floor 12 and a plurality of symmetrically oriented upstanding side walls. Preferably, container 10 is substantially square-shaped having two pairs of opposing side walls 14, 18 and 16, 20, respectively. The edges defined between adjacent side walls are preferably identically beveled to thereby define four substantially identical planar corner walls 22, 24, 26 and 28. The corner walls are desired, but not essential to the invention. They may be used to carry locking fasteners or handles (both not shown) for the reasons stated below.

It is essential, however, that container 10 be symmetrical. As will be more clearly described below with reference to FIG. 6, such configuration enables two identical containers 10 to be interconnected in inverted relation to thereby define the top and bottom of a closed housing for storing textile materials or yarn in an enlarged stage during their working schedule. Alternatively, when the textile materials or yarns are of small amount, a single container 10 may be closed with a substantially planar cover (to be described later) to define a housing with a reduced internal storage volume.

Container 10 is preferably fabricated of material that is resistant to environmental corrosion, such as a plastic. More particularly, container 10 is preferably fabricated of a polyolefin, the most preferred polyolefin being polypropylene consisting essentially of isotactic macromolecules inasmuch as it is strong and also highly resistant to degradation. This permits container 10 to be used for prolonged periods without damage and deterioration from handling or environmental elements, such as humidity or the like.

Referring now more particularly to the configuration of container 10, at least one side wall of the container, such as side wall 20, has an extending portion, such as an elongate flange 30, extending a predetermined distance outwardly of an outer surface 32 of side wall 20. Flange 30 includes an elongate finger 34 defined thereon extending a predetermined distance above an upper end 36 of side wall 20. Elongate finger 34 is of predetermined height and preferably extends transversely, in a direction parallel to floor 12, a distance at least as great as side wall 20. Preferably, the entire flange extends the full width of side wall 20 so as to overlap one half the upper transverse extent of corner walls 28 and 22.

At least one other side wall, such as side wall 14, includes an elongate flange 38 having an elongate recessed groove 40 defined therein. Generally speaking, groove 40 is recessed below an upper end 37 (of identical height as upper end 36 of side wall 20) a distance at least equal to the predetermined distance finger 34 of flange 30 extending above upper end 36. The other overall dimensions of groove 40, such as transverse width and depth, are at least as great as elongate finger. In this regard, flange 38 has a transverse extent in a direction parallel to floor 12 at least as great as, and preferably substantially equal to, the transverse extent of flange 30.

Figure 2:
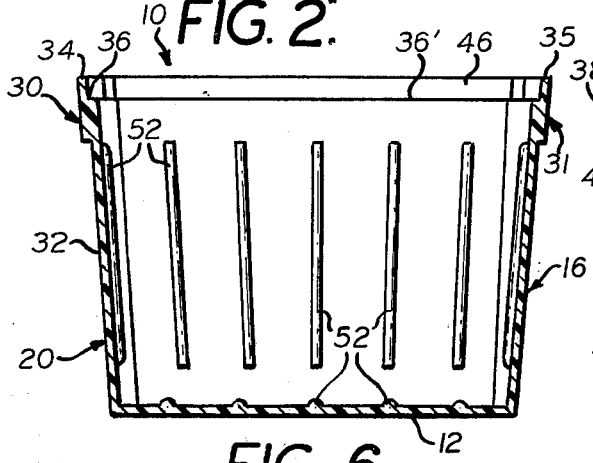
FIG. 2 is a side cross-sectioned view of the container of FIG. 1 taken along lines A—A of FIG. 1.
Figure 3:
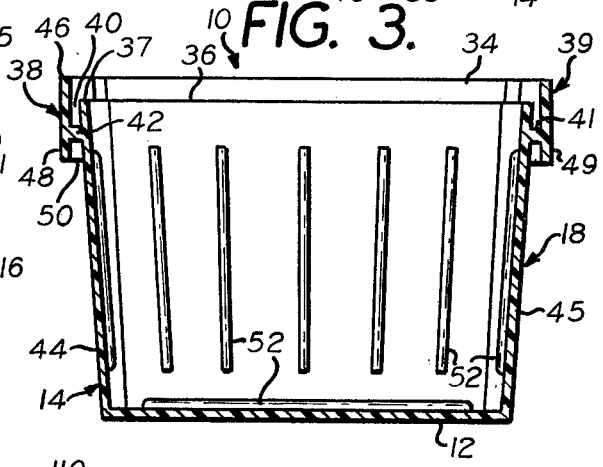
FIG. 3 is a side cross-sectioned view of the container of FIG. 1 taken along lines B—B of FIG. 1.

Referring specifically to FIGS. 2 and 3, flange 38 is preferably substantially T-shaped in cross-section with a single elongate leg 42 thereof extending from an outer surface 44 of side wall 14 a distance at least equal to the thickness of elongate finger 34, groove 40 being defined between an upper elongate arm 46 of flange 38 and surface 44. Preferably, the upward extent of arm 46 equals that of finger 34.

Flange 38 has a lower elongate arm 48 of the T-section extending downwardly a distance at least equal to the predetermined distance of upward extent of finger 34 above upper end 36 of side wall 20. Another recess or groove 50 is thus defined between leg 48 and surface 44. Groove 50 is not essential to the invention and may be eliminated, if desired, by deleting arm 48 of flange 38.

Thus defined, and due to the symmetry of container 10, another container 10', identical to container 10, may be rotated 90° relative to container 10 and then placed on top thereof in inverted mating relation. For example, see FIG. 6 wherein an elongate finger 34' of container 10', identical to finger 34, is positioned in groove 40 of container 10, and, although not shown, elongate finger 34 of container 10 is positioned in an elongate groove 40' identical to groove 40. This relationship is more clearly described below.

Container 10 may have the cross-sectional configuration of any symmetrically-shaped polygon, such as an equilateral triangle, square, pentagon or hexagon, for example. If a square is desirable, such as depicted by container 10, it is preferred that side wall 18 opposite side wall 14 also include an elongate recess or groove 41 defined in a recessed portion, such as an elongate flange 39, flange 39 and groove 41 being identical to flange 38 and groove 40 of side wall 14. Correspondingly, it is preferred that side wall 16, opposite side wall 20, also include an extending portion, such as an elongate flange 31 having an extending elongate finger 35, flange 31 and finger 35 being identical to flange 30 and finger 34 of side wall 20.

Figure 6:
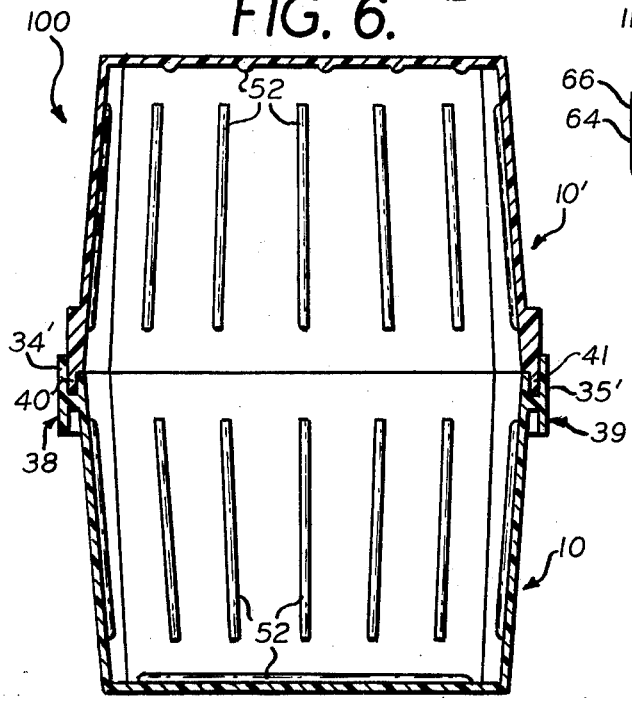
FIG. 6 is a side cross sectional view of a housing for receiving textile materials, such as cops, reels, spindles or the like which is formed by disposing a pair of the containers shown in FIG. 1 in inverted relationship.

Defining both pairs of opposing side walls in the above manner permits more efficient interlocking of identical containers 10 and 10' disposed in inverted mating relation, as shown in FIG. 6. More specifically, elongate fingers 34' and 35' of container 10' are respectively mated with grooves 40 and 41 of container 10, as shown, whereas elongate fingers 34 and 35 of container 10 are respectively mated with recesses 40' and 44' of container 10' (not shown). A closed housing 100 is thus defined which may be used to store yarn or textile materials in a bulky stage of its working schedule due to the doubled internal volume of the housing over just a single container alone.

It should be noted that it is not essential for elongate fingers 34 and 35 to be defined on a separate outwardly extending flange and 31, respectively, or the like. Alternatively, an elongate finger (not shown) similar to fingers 34 and 35 may extend directly from the upper ends of side walls 16 and 20. Correspondingly, a recess or groove (not shown), dimensioned to mate with such similar fingers, may be recessed directly within each of side walls 14 and 18, providing that the thickness of each of the side walls is substantially greater than that of fingers 34.

It must also be pointed out that it is not essential for more than one side wall to have an alongate finger and a corresponding number of side walls to have complementary recessed portions. All that is required in any polygon-shaped container of this invention is that the container be symmetrical as defined by its floor and side walls, and that at least one side wall have an extending portion and at least one side wall have a complementary recessed portion dimensioned to mate with each other so that two identical containers may be interlocked in inverted mating relation.

Although not essential to this invention, container 10 preferably includes a plurality of spaced stiffening ribs 52 integrally defined on the inner surfaces of floor 12 and each side wall. The ribs are molded directly onto the plastic material of the container. Alternatively, the ribs may be defined on the outer surfaces of the container. Furthermore, the ribs may alternatively be defined by separate metallic rods (not shown) mounted about the floor and side walls of the container in mounting jackets (not shown) molded integrally on either or both the inner and outer surfaces of the container. Moreover, such ribs 52 can extend either partially on the walls, as showed in figures, or from the bottom up to top of the wall.

Preferably, each of the side walls of container 10 is tapered from a maximum transverse extent along its upper end to a minimum transverse extent along its lower end at floor 12. Such tapering, although not required, is desirable since it adds strength and rigidity to the container.

As pointed out above, the edges between adjacent side walls are preferably identically beveled to thereby define corner walls 22–28. Each corner wall is planar and of identical truncated triangular configuration (due to the tapered side walls). The corner walls may be used to mount conventional fastening or holding devices (not shown) so that a closed housing, such as housing 100 (FIG. 6), may be locked, sealed and carried. These devices have been omitted from the drawing for purposes of clarity.

Container 10 may not only be used as both a bottom and top to form housing 100, but solely as a bottom to form a housing 110 of diminished internal volume (FIG. 5) which may be closed by a substantially planar cover 60. Housing 110, therefore, has an internal volume essentially half that of housing 100. The importance of this dual use of container 10 is that it enables only a singularly configured container to be stocked for storing fabric or yarn or the like regardless of the bulk or volume thereof at any particular time in the working schedule. This permits both housings 100 and 110 to be defined by a singularly configured container manufactured from a common mold or form, thereby reducing costs and waste.

In accordance with this invention, cover 60 preferably has the identical symmetrical polygon configuration as container 10, although such need not be the case. What is important about cover 60, however, is that it include a top 62, preferably planar, having at least one extending portion including an elongate finger. The finger is dimensioned substantially identically as finger 34 of container 10 and extends from a position on top 62 so as to be aligned with, for reception in, one of grooves 40 or 41 on container 10 when cover 60 is mounted on top of the container (see FIG. 5).

Figure 5:
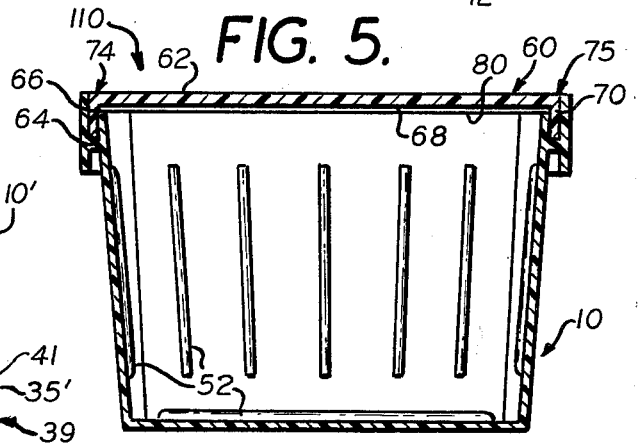
FIG. 5 is a side cross sectional view of the container of FIG. 1 taken along lines B—B wherein a substantially planar cover is disposed on top of the container.

Preferably, therefore, cover 60 is substantially square in shape and has four side edges 66, 68, 70 and 72, side edge 72 being obscured from view in FIG. 5. As with container 10, the corner edges are each identically beveled to preserve symmetry. Preferably, a pair of elongate fingers 64 and 65, each identical to finger 34 of container 10, extend from each of opposing edges 66 and 70. More specifically, fingers 64 and 65 are respectively defined by a pair of opposing elongate flanges 74 and 75 extending from edges 66 and 70, respectively. Since cover 60 preferably has the identical configuration as container 10, fingers 34 and 35 of container 10 will be caused to abut the periphery of edges 68 and 72 of cover 60 when the latter is positioned thereon (such relationship being obscured from view in FIG. 5). Alternatively, if cover 60 is larger than container 10, it may be defined with complementary grooves therein spaced to receive the elongate fingers of container 10 when positioned thereon, providing the cover is made thick enough. As with container 10, cover 60 is preferably fabricated of a plastic material, polypropylene consisting essentially of isotactic macromolecules being preferred.

Although the present invention has been described with reference to a number of presently preferred embodiments, the invention is not to be so limited. Rather, obvious modifications (for instance a container of cross-sectional circular configuration) and changes to the embodiments shown, only some of which being described above, may be made without departing from the spirit of the invention as defined in the following claims:

What is claimed is:

1. A housing for storing items of desired size and shape comprising:

a. a container of symmetrical regular polygon configuration having a floor and side walls upstanding therefrom at all the same distance;

b. one group of alternate side walls including outwardly extending elongate grooveless flanges at the tops thereof including elongate fingers extending above the tops of said one group of walls along the entire width thereof; and c. the other group of alternate side walls including outwardly extending elongate fingerless flanges at the tops thereof having elongate grooves therein complementary to said fingers and extending along the entire width of said walls of said other group for receiving said elongate fingers of said first group of walls, whereby two such housings may be brought together with their tops in confronting relation with one group of walls of one such housing in juxtaposition with the other group of walls of the other of such housings, and vice versa, to form a single closed container of about twice the volume of said housing.

2. The housing of claim 1 wherein the container is substantially square in shape having two pairs of opposing side walls, wherein each side wall of one pair has said extending flange and each side wall of the other pair has said recessed groove.

3. The housing of claim 1 further comprising a substantially flat cover to close the housing, said cover being dimensioned to mate with the container.

4. The housing of claim 1 wherein the side walls of the container are each tapered from a maximum transverse dimension at the upper end thereof to a minimum transverse dimension at the lower end thereof.

5. The housing of claim 1 wherein the floor and side walls of the container each include a plurality of stiffening ribs.

6. The housing of claim 1 wherein the container has edges between adjacent side walls which are beveled to define a corresponding plurality of substantially planar corner walls.

7. The housing of claim 1 wherein the container material is a plastic.

8. The housing of claim 1 wherein said container is made of polypropylene consisting essentially of isotactic macromolecules.

* * * * *

UNITED STATES PATENT OFFICE

CERTIFICATE OF CORRECTION

Patent No. 4,014,450 Dated March 29, 1977

Inventor(s) Floriano Girotti et al.

It is certified that error appears in the above-identified patent and that said Letters Patent are hereby corrected as shown below:

The term of this patent subsequent to September 29, 1992 has been disclaimed.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*